US007246579B2

(12) United States Patent
Kimura et al.

(10) Patent No.: US 7,246,579 B2
(45) Date of Patent: Jul. 24, 2007

(54) ACTUATOR FOR VALVE LIFT CONTROLLER

(75) Inventors: Kiyoshi Kimura, Obu (JP); Shigeru Yoshiyama, Kariya (JP); Taku Itoh, Chita-gun (JP); Hideo Inaba, Okazaki (JP); Joji Yamaguchi, Chiryu (JP); Akihiko Kameshima, Hekinan (JP); Toshiki Fujiyoshi, Okazaki (JP)

(73) Assignee: DENSO Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/344,182

(22) Filed: Feb. 1, 2006

(65) Prior Publication Data

US 2006/0169234 A1 Aug. 3, 2006

(30) Foreign Application Priority Data

Feb. 1, 2005 (JP) ..... 2005-025306

(51) Int. Cl.
*F01L 1/34* (2006.01)

(52) U.S. Cl. ..... 123/90.16; 123/90.17; 123/90.15; 123/90.18; 123/90.33

(58) Field of Classification Search ..... 123/90.16
See application file for complete search history.

(56) References Cited

U.S. PATENT DOCUMENTS

| | | | | |
|---|---|---|---|---|
| 5,979,382 | A * | 11/1999 | Heer | 123/90.17 |
| 7,004,127 | B2 * | 2/2006 | Shibata et al. | 123/90.16 |
| 7,100,553 | B2 * | 9/2006 | Suzuki et al. | 123/90.16 |
| 2004/0083997 | A1 | 5/2004 | Shibata et al. | |

* cited by examiner

*Primary Examiner*—Thomas Denion
*Assistant Examiner*—Kyle M. Riddle
(74) *Attorney, Agent, or Firm*—Nixon & Vanderhye P.C.

(57) ABSTRACT

An actuator for a valve lift controller comprises a case forming a first and second spaces therein. The first space is supplied with lubricating fluid. The actuator further comprises a feed screw mechanism including a cylindrical spindle and a screw, and converts a rotational movement of the spindle to a linear movement of the screw. The spindle includes a first end portion open to the first space and a second end portion closed to the second space therein. The screw straddles borders between an interior of the spindle, the first space, and an external space. The actuator includes a motor unit which is located in the second space and rotates the spindle. The actuator further includes a sealing member sealing a gap between the case and the spindle to separate the first and second spaces.

7 Claims, 3 Drawing Sheets

ACTUATOR FOR VALVE LIFT CONTROLLER

CROSS REFERENCE TO RELATED APPLICATION

This application is based on Japanese patent application No. 2005-25306 filed on Feb. 1, 2005, the disclosure of which is incorporated herein by reference.

FIELD OF THE INVENTION

The present invention relates to a valve lift controller for controlling a lift amount of an intake valve and/or an exhaust valve of an internal combustion engine (hereafter referred to simply as an engine).

BACKGROUND OF THE INVENTION

In a conventional valve lift controller, several types of actuators are used for linearly driving an axis of a changing mechanism which controls a lift amount of a valve based on a position of the axis. For example, an actuator is described in US 2004-0083997A1 (JP 2004-150332A) which converts, by means of a reduction mechanism and a cam mechanism, a rotational driving force into a linear driving force and apply the linear driving force to the axis of the changing mechanism.

The conventional actuator, however, has to use the reduction mechanism in combination with the cam mechanism to make the linear driving force strong. It is therefore difficult to design the actuator to be small. Thus, positions where the actuator can be located may be limited.

The inventors of the present invention have studied a structure of a feed screw mechanism which converts a rotational movement of a rotation axis to a linear movement of a screwed axis. The feed screw mechanism can generate the strong linear driving force by means of a simple structure in which the rotation axis and the screwed axis are coaxially connected directly or indirectly. An actuator with the feed screw mechanism therefore can be designed to be smaller than the actuator with the reduction mechanism and the cam mechanism.

The inventers, however, found a problem in decreasing the size of the actuator in the case that the feed screw mechanism and the motor unit are installed in the same housing. When lubricating oil is supplied into the housing to lubricate a friction making portion of the feed screw mechanism, the motor unit in the housing receives the lubricating oil. Especially, if the motor unit is designed to drive a spindle by exiting a coil, the lubricating oil causes defect in the motor unit such as disconnection. It is important for improvement of endurance of the actuator to avoid the defect caused by the lubricating oil.

SUMMARY OF THE INVENTION

It is therefore an object of the present invention to provide an actuator for a valve lift controller which can be designed to be small and endurable.

An actuator for a valve lift controller includes a case forming a first space and a second space therein. The first space is supplied with lubricating fluid. The actuator further includes a feed screw mechanism including a rotation spindle and a screwed shaft, and converts a rotational movement of the rotation spindle to a linear movement of the screwed shaft. The rotation spindle has a shape of a cylinder with a bottom portion and includes a first and second end portions. The first end portion connects the first space with an interior space of the rotation spindle. The second end portion which is located in the second space separates the second space from the interior space.

The actuator further includes a motor unit which includes a coil located in the second space and rotates the rotation spindle when the coil is excited. The actuator further includes a sealing member sealing a gap between the case and the rotation spindle to separate the first space and the second space.

The lubricating oil supplied to the first space is thus prohibited from entering the second space through the gap between the case and the rotation spindle, because the first space and the second space are separated by the sealing member.

In addition, the lubricating oil supplied to the first space is allowed to flow into the interior space of the rotation spindle but prohibited from flowing into the second space through the interior space, because the first end portion connects the first space with an interior space of the rotation spindle and the second end portion separates the second space from the interior space.

It is therefore possible to prevent the coils of the motor unit in the second space from suffering from the lubricating oil while lubricating a friction making portion with the lubricating oil in the interior space. It is thus possible to improve endurance of both the feed screw mechanism and the motor unit.

In addition, the feed screw mechanism, which has a relatively simple structure of the rotation spindle and the screwed shaft, is used as a mechanism to convert the rotational movement of the motor unit to the linear movement of the control shaft. It is therefore possible to reduce the size of the actuator.

BRIEF DESCRIPTION OF THE DRAWINGS

The invention, together with additional objective, features and advantages thereof, will be best understood from the following description, the appended claims and the accompanying drawings. In the drawings:

DETAILED DESCRIPTION OF THE EMBODIMENTS

Figure 2A:
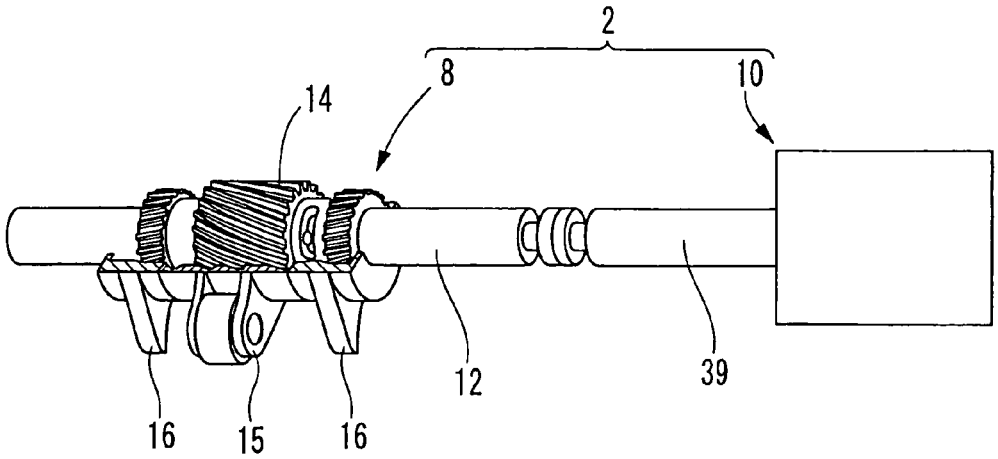
FIG. 2A is a partially cross-sectional view showing the valve lift controller.
Figure 2B:
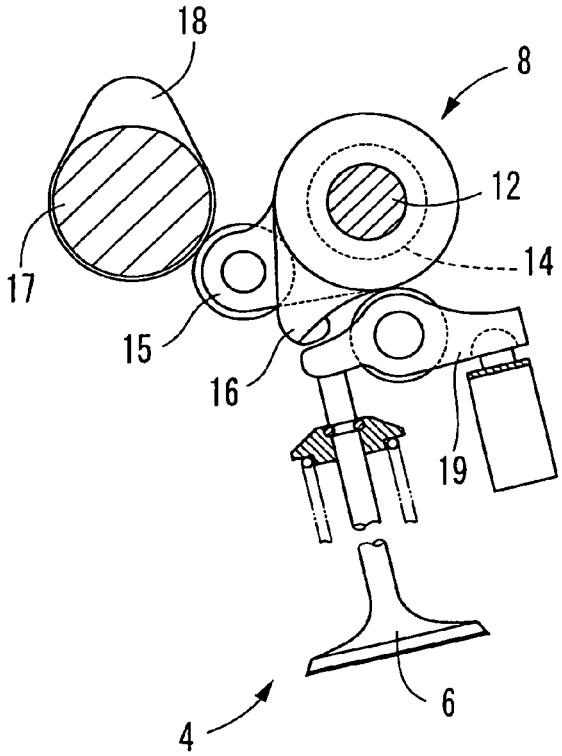
FIG. 2B is a cross-sectional view showing the valve lift controller.

As shown in FIGS. 2A and 2B, a valve lift controller 2 according to an embodiment includes a changing mechanism 8 and an actuator 10, and controls a lift amount of an intake valve 6 of an engine 4.

The changing mechanism 8, which is disclosed in for example JP 2001-263015A, is mounted on the engine 4 and includes a control shaft 12, a slide gear 14, an input unit 15, and swinging cams 16. The slide gear 14 is linearly movable along with the control shaft 12 in the axial direction of the control shaft 12 and is engaged with a helical spline on inner surfaces of the input unit 15 and the swinging cams 16. A difference between rotational phases of the input unit 15 and the swinging cams 16 around the axial direction changes according to a position of the control shaft 12 in the axial direction.

The input unit 15 is in contact with an intake cam 18 of a camshaft 17, and one of the swinging cams 16 can be in contact with a rocker arm 19 of the intake valve 6. A swing angle range, which is a range of angle around the axial direction within which the swinging cam 16 can move, varies depending on the difference between the rotational phases of the input unit 15 and the swinging cams 16. Therefore, the changing mechanism 8 controls a valve lift amount, which is an amount of an upward movement of the intake valve 6, depending on the position of the control shaft 12 in the axial direction, and thereby controls characteristics of the intake valve 6 such as a valve acting angle or the maximum valve lift amount. In the embodiment, a valve resistance force, which is a force applied by the intake valve 6 to the control shaft 12, serves as a thrust force applied in a direction opposite to a direction from the control shaft 12 to the actuator 10.

Figure 3:
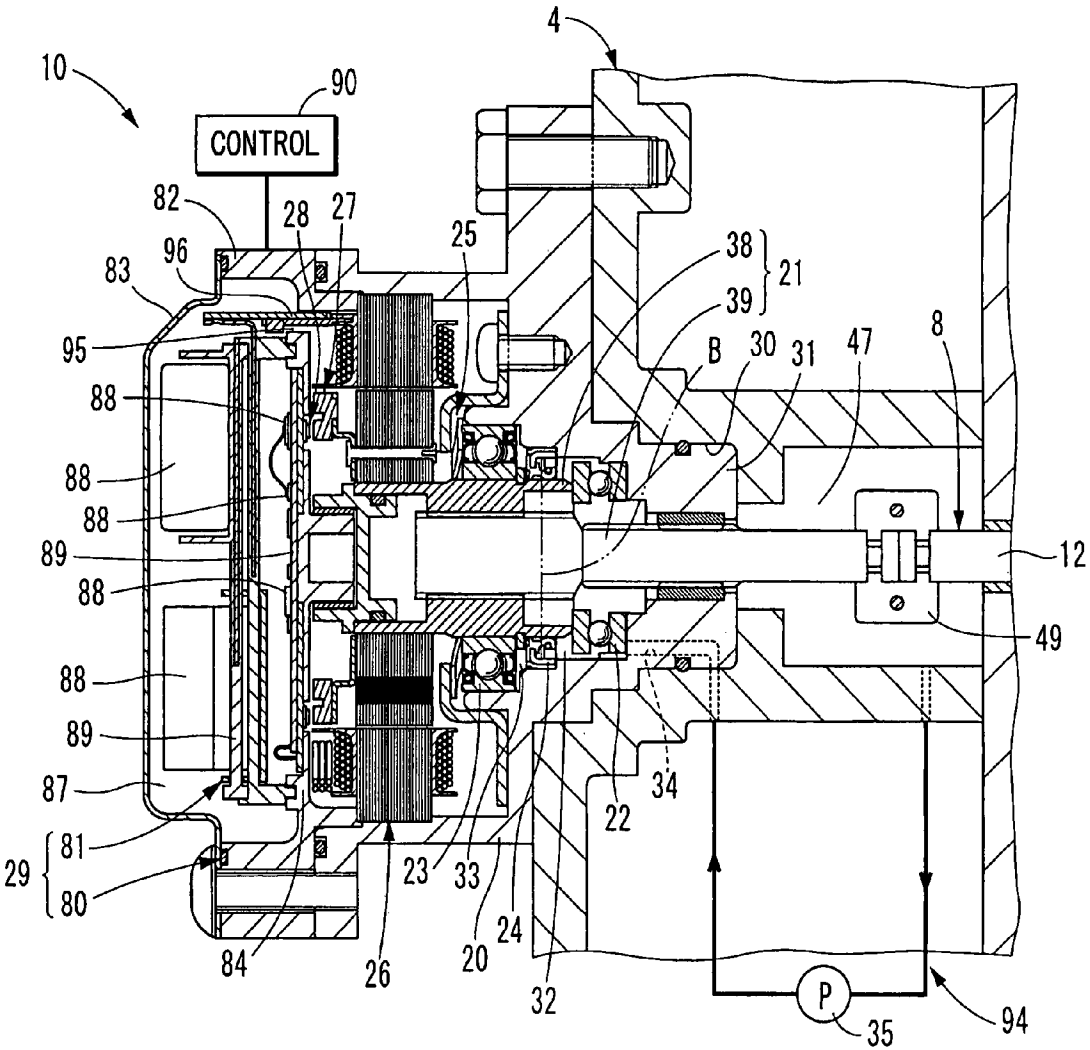
FIG. 3 is a cross-sectional view showing the actuator for the valve lift controller.

The actuator 10 moves the control shaft 12 in the axial direction. As shown in FIG. 3, the actuator 10 includes a case 20, a feed screw mechanism 21, a thrust bearing 22, a radial bearing 23, an oil seal 24, a displacement restriction unit 25, a motor unit 26, a magnet unit 27, a sensing unit 28, and an electric power distributor 29. The actuator 10 is installed in a vehicle so that the direction from the right to the left in FIG. 3 corresponds to a horizontal direction.

The case 20 has a cylindrical shape having a bottom portion 31 which is fitted in a mounting hole 30 of the engine 4 and is fixed to the engine 4 with bolts. The case 20 has a first space 32 and a second space 33 adjacent to the first space 32. The border between the first and second spaces 32 and 33 is illustrated in FIG. 3 by an alternate long and two short dashes line B. The first space 32, which is closer to the bottom portion 31 than the second space 33, is supplied with lubricating oil by an oil pump 35 of the engine 4 through an oil supplying hole 34 penetrating the case 20.

The feed screw mechanism 21 serves as a trapezoid screw mechanism formed by a rotation spindle 38 and a screwed shaft 39 which are arranged coaxially. The rotation spindle 38 has a cylindrical shape having a bottom portion, straddles the border B between the first and second spaces 32 and 33, and is thereby located at a position between the control shaft 12 and the electric power distributor 29. As shown in an enlarged view in FIG. 1, the rotation spindle 38 includes a screw nut 41 having on its inner periphery an internal thread 40 a cross section of which has a shape of a trapezoid. The rotation spindle 38 also includes a lid 42 and a circlip 43 which are attached to the screw nut 41.

The screw nut 41 is supported by the thrust bearing 22 and the radial bearing 23, which are arranged coaxially with the screw nut 41, and thereby is capable of rotating back and forth around the axial direction. An end portion 41*a* of the screw nut 41 is opened to the first space 32. In other words, the end portion 41*a* connects the first space 32 with an interior space 46 of the screw nut 41. The other end portion 41*b* is covered in the second space 33 by the lid 42. In other words, the lid 42 of the rotation spindle 38 separates the second space 33 from the interior space 46. The lid 42 includes a sleeve unit 44 having a cylindrical shape coaxial with the screw nut 41. The sleeve unit 44 has an open end facing the electric power distributor 29 in the axial direction. The circlip 43 has a shape of a letter C and is engaged with a radial groove 45 on an outer periphery of the screw nut 41. The circlip 43 is not capable of moving relative to the screw nut 41 in the axial direction.

The screwed shaft 39 is located, straddling the borders between the bottom portion 31, an interior space 46 of the screw nut 41, the first space 32, and an oil passage 47 of the engine 4, and is thereby located at a position between the control shaft 12 and the electric power distributor 29. An external thread 48 a cross section of which has a shape of a trapezoid is on an end portion of an outer periphery of the screwed shaft 39, the end portion close to the screw nut 41. The external thread 48 and the internal thread 40 of the screw nut 41 are screwed together. The screwed shaft 39 therefore moves in the axial direction caused by a rotational movement of the rotation spindle 38. Thus, the feed screw mechanism 21 converts the rotational movement of the rotation spindle 38 into a liner movement of the screwed shaft 39.

As shown in FIG. 3, an end of the screwed shaft 39 close to the oil passage 47 is coaxially connected, through a joint member 49, with an end of the control shaft 12 opposite to the slide gear 14. The screwed shaft 39 therefore is linearly movable along with the control shaft 12.

Figure 1:
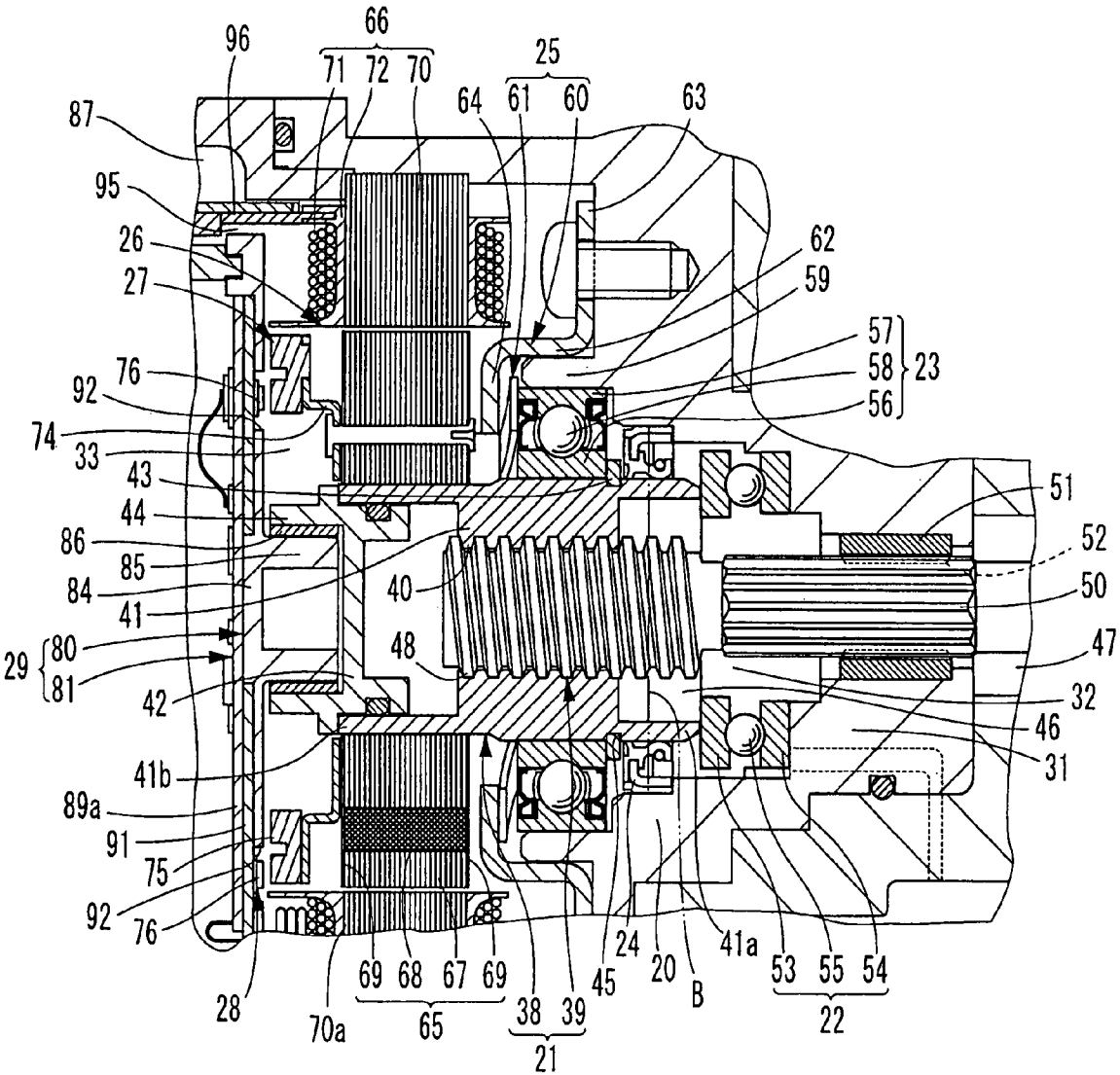
FIG. 1 is a cross-sectional view showing a main portion of an actuator for a valve lift controller according to an embodiment of the present invention.

As shown in FIG. 1, a first involute spline 50 is formed on a middle portion of the outer periphery of the screwed shaft 39. A rotation restriction bush 51 is engaged with and fixed circumferentially to a portion of the inner periphery of the bottom portion 31. A second involute spline 52 is formed on the inner periphery of the rotation restriction bush 51 and is radially engaged with the first involute spline 50. The first and second involute splines 50 and 52 restrict a rotation of the screwed shaft 39 and misalignment of the screwed shaft 39 from the axial direction, while suppressing friction resistance applied to the screwed shaft 39. Thus, the conversion efficiency of the movements at the feed screw mechanism 21 is improved. In addition, the lubricating oil is discharged from the first space 32 to the oil passage 47 through a gap between the screwed shaft 39 and the rotation restriction bush 51. The lubricating oil discharged to the oil passage 47 is sent to the oil pump 35 as shown in FIG. 3. A lubricating oil exchange system 94 is thus formed in which the lubricating oil flows through the oil pump 35, the oil supplying hole 34, the first space 32, the gap between substances 39 and 51, and the oil passage 47 in this order.

As shown in FIG. 1, the thrust bearing 22 supporting the rotation spindle 38 against the thrust force is located in the first space 32 and is an axial contact type ball bearing including an inner race 53, an outer race 54, and ball-shaped rolling bodies 55 between the races 53 and 54. A gap between the inner race 53 and the outer race 54 is connected with the first space 32. The outer race 54 is engaged with the inner periphery of the case 20. The inner race 53 is attached to the end portion 41*a* of the screw nut 41, the end portion 41*a* facing the control shaft 12 in the axial direction. The outer race 54 is attached to a part of the bottom portion 31, the part facing the screw nut 41 in the axial direction.

The radial bearing 23 supporting the rotation spindle 38 against a radial force applied to the rotation spindle 38 is located in the second space 33 and is a radial contact type ball bearing including an inner race 56, an outer race 57, and ball-shaped rolling bodies 58 between the rings 56 and 57. A gap between the inner race 56 and the outer race 57 is sealed and is filled with grease. The inner race 56 is engaged with the outer periphery of the screw nut 41. The circlip 43 is attached to a side face of the inner race 56 facing the control shaft 12 in the radial direction. The outer race 57 is engaged with the inner periphery of a retainer portion 59 which sticks out from the inner periphery of the case 20 and has a cylindrical shape.

The oil seal 24 is press-fitted to the inner periphery of the case 20 and then the screw nut 41 is inserted in an inner peripheral side of the oil seal 24. The oil seal 24 is thus provided between the case 20 and the end portion 41*a* of the screw nut 41, by being pressed ant fitted to the inner periphery of the case. 20 and then by. The oil seal 24 is located at the border B between the first space 32 and the second space 33 and at an opposite side of the circlip 43 to the radial bearing 23. Thus, the oil seal 24 seals a gap between the case 20 and the screw nut 41 to liquid-tightly separate the first space 32 and the second space 33.

The displacement restriction unit 25 includes a stopper 60 and a wave washer 61 and is located in the second space 33. The stopper 60 includes an engagement portion 62, a fixing portion 63, and an obstacle portion 64.

The engagement portion 62 has a cylindrical shape and is engaged with the outer periphery of the retainer portion 59. The fixing portion 63 has a shape of an annular disk projecting radially outward from an end of the engagement portion 62 and is screwed to the inner periphery of the case 20. The obstacle portion 64 is located in the axial direction from the outer race 57 and between the outer race 57 and the electric power distributor 29. The obstacle portion 64 has a shape of an annular disk projecting radially inward from the other end of the engagement portion 62.

The wave washer 61 is located between the obstacle portion 64 and the outer race 57 and has a shape of an annular disk. The wave washer 61, which is coaxial with the obstacle portion 64 and the outer race 57, is compressed in the radial direction by the obstacle portion 64 and the outer race 57. The compression causes the wave washer 61 to generate a restitution power. By means of the restitution power, the wave washer 61 applies to the obstacle portion 64 a force in the axial direction toward the electric power distributor 29 and also applies to the outer race 57 a force in the axial direction toward the control shaft 12. Backlash between the obstacle portion 64 and the outer race 57 is therefore suppressed.

The motor unit 26 is a brushless motor formed by a rotating rotor 65 and a stator 66 and is located in the second space 33. The rotating rotor 65 includes a rotor core 67, permanent magnets 68, and magnet covers 69. The rotor core 67 is formed by laminated pieces of iron each having a shape of an annular disk and is engaged with the outer periphery of the end portion 41*b* of the screw nut 41 coaxially with the screw nut 41. The rotor core 67 is capable of rotating back and forth along with the rotation spindle 38 and thereby serves as a motor shaft for the motor unit 26.

The permanent magnets 68 and the magnet covers 69 are attached to the rotor core 67. The permanent magnets 68 are embedded near an outer rim of the rotor core 67 in the circumferential direction of the rotor core 67 at a constant interval. The magnet covers 69 are nonmagnetic substances having a form of an annular disk and are provided at both ends of the rotor core 67 in the axial direction. The two magnet covers 69 thus restrict the positions of the multiple permanent magnets 68 between themselves.

The stator 66 is located at an outer peripheral side of the rotating rotor 65 and has a stator core 70, coils 71, and bobbins 72. The stator core 70 includes projecting portions 70*a* which radially project inward. The stator core 70 is formed by laminated pieces of iron to have a shape of blocks and is attached to the inner periphery of the case 20. The coils 71 are wound around respective projecting portions 70*a* with intermediation of respective bobbins 72.

The magnet unit 27 is located in the second space 33 and includes a magnet holder 74 and a permanent magnet 75 which has multiple magnetic poles circumferentially arranged facing an end surface of the sensing unit 28. The magnet holder 74 is made of magnetic material and is fixed together with the magnet cover 69 by rivets to the side of the rotor core 67 close to the electric power distributor 29. The permanent magnet 75 is engaged with and magnetically attached to a predetermined position of the magnet holder 74. The magnet unit 27, which includes the magnet holder 74 and the permanent magnet 75, is therefore capable of rotating back and forth together with the rotating rotor 65 and the rotation spindle 38.

The sensing unit 28 is constructed by multiple Hall elements 76, located apart from the magnet unit 27 in the axial direction between the electric power distributor 29 and the magnet unit 27, and exposed to the second space 33. Each of the Hall elements 76 is fixed to a predetermined location of the electric power distributor 29 and detects, by receiving magnetic effect from the permanent magnet 75 of the magnet unit 27, a rotational angle of the rotation spindle 38. The magnet unit 27 and sensing unit 28 are designed so that the Hall elements 76 output signals each having a predetermined correlation with the rotational angle of the rotation spindle 38, which rotates to change the positions of the magnetic poles of the permanent magnet 75.

The electric power distributor 29, as shown in FIG. 3, includes a circuit case 80 and a driving circuit 81 in the circuit case 80. The circuit case 80 is fixed by bolts to the case 20 and includes a base member 82 and a covering member 83 each of which has a shape of a cup. The base member 82 has a bottom portion 84 covering the opening of the case 20 and faces the direction opposite to the case 20. As shown in FIG. 1, the base member 82 also has a supporting portion 85 protruding from the bottom portion 84 to the case 20. The supporting portion 85 has a shape of a cylinder and is inserted into the sleeve unit 44 of the lid 42 coaxially with the lid 42. A sliding bush 86 having a shape of a cylinder is inserted between the supporting portion 85 and the sleeve unit 44, which is thereby supported by the supporting portion 85 through the sliding bush 86. It is thus possible to prevent the rotation spindle 38 from inclining around its supporting point adjacent to the radial bearing 23, because a displacement of the sleeve unit 44 toward a radial direction perpendicular to the axial direction is restricted.

As shown in FIG. 3, an edge portion of the base member 82 at an opening of the base member 82 is liquid-tightly attached to an edge portion of the covering member 83 at the opening of the covering member 83. The driving circuit 81 is located in a container space 87 surrounded by the base member 82 and the covering member 83. The driving circuit 81 is an electric circuit formed by piling up in the axial direction multiple substrates 89 on which circuit elements 88 are mounted. The driving circuit 81 is electrically connected with each of the coils 71 in the motor unit 26 through an electrically conductive member 96. The electrically conductive member 96 is located in a communication hole 95, which is formed in the base member 82 and makes the container space 87 communicate with the second space 33. The driving circuit 81 is also connected through a terminal (not shown) with a controlling circuit 90 at an outside of the circuit case 80. As shown in FIG. 1, a substrate 89*a* of the substrates 89 is engaged with and fixed to the bottom portion 84 of the base member 82. Another substrate 91 on which the Hall elements 76 of the sensing unit 28 are mounted is inserted between the substrate 89*a* and the bottom portion 84. The driving circuit 81 is also electrically connected with the Hall elements 76. The Hall elements 76 are exposed to the second space 33 through penetration holes 92 penetrating the bottom portion 84 of the base member 82.

The controlling circuit 90 is an electric circuit receiving through the driving circuit 81 the signal outputted from the Hall elements 76 and thereby detecting the rotation angle of the rotation spindle 38 and a position in the axial direction of the control shaft 12. The controlling circuit 90 further estimates the actual valve lift amount and gives an instruction to the driving circuit 81 for outputting electric power for compensating a difference between the estimated actual valve lift amount and a target valve lift amount. According to the instruction, the driving circuit 81 rotates the rotating rotor 65 and rotation spindle 38 by controlling the electric power to the coils 71 and thereby exciting the coils 71 in a predetermined order. The screwed shaft 39 and the control shaft 12 are thus driven linearly in the axial direction, and, as a result, the target valve lift amount is achieved. The target valve lift amount is a physical quantity determined by, for example, the controlling circuit 90 depending on driving conditions of a vehicle such as an engine rotational speed, and a throttle position.

In this embodiment, the oil seal 24 at the border B between the first space 32 and the second space 33 separates the first space 32 from the second space 33. Therefore, the lubricating oil supplied to the first space 32 is prohibited from entering the second space 33 through a gap between the case 20 and the screw nut 41.

In addition, the end portion 41*a* of the screw nut 41 is open to the first space 32 and the other end portion 41*b* of the screw nut 41 is closed to the second space 33 in the second space 33. The lubricating oil supplied to the first space 32 is thus allowed to enter the interior space 46 of the screw nut 41 from the end portion 41*a*, but is prohibited from entering the second space 33 through the interior space 46. It is therefore possible to prevent the coils 71 of the motor unit 26 from suffering from the lubricating oil while lubricating with the lubrication oil in the interior space 46 friction making portions, that is, interlocking portions of the internal thread 40 and the external thread 48. It is thus possible to improve endurance of both the feed screw mechanism 21 and motor unit 26.

The radial bearing 23 containing the grease is located in the second space 33 which the lubricating oil cannot enter from the first space 32. It is therefore possible to avoid deterioration of endurance of the radial bearing 23 which is caused by suffering from the lubricating oil.

The thrust bearing 22 in the first space 32 has the gap between the inner race 53 and the outer race 54 which is connected with the first space 32. The lubricating oil in the first space 32 can thus enter the gap between the inner race 53 and the outer race 54. It is therefore possible to improve endurance of the thrust bearing 22.

The driving circuit 81 is in the container space 87, which is in the circuit case 80 and communicates through the communication hole 95 with the second space 33 which the lubricating oil does not enter from the first space 32. It is thus possible to prevent the driving circuit 81 and the coils 71 from suffering from the lubricating oil, while reducing manufacturing cost by eliminating a seal on the communication hole 95 through which the conductive member 96 connects the driving circuit 81 with the coils 71.

The sensing unit 28 detecting the rotational angle of the rotation spindle 38 is exposed to the second space 33 which the lubricating oil does not enter from the first space 32. It is thus possible to prevent the sensing unit 28 from suffering from the lubricating oil, while surely detecting the rotational angle of the rotation spindle 38.

The feed screw mechanism 21, which has a relatively simple structure of the rotation spindle 38 and the screwed shaft 39, is used as a mechanism to convert the rotational movement of the motor unit 26 to the linear movement of the control shaft 12. Moreover, the electric power distributor 29 and the control shaft 12 are located at the opposite locations relative to the feed screw mechanism 21 in the axial direction. It is therefore possible to design the actuator 10 to be small.

The lubricating oil in the first space 32 is discharged to the oil passage 47 of the engine 4 through the gap inevitably formed between the screwed shaft 39 and the rotation restriction bush 51. It is therefore possible to form the lubricating oil exchange system 94 for exchanging the lubricating oil between the engine 4 and the actuator 10 while suppressing manufacturing cost of the lubricating oil exchange system 94.

The present invention should not be limited to the embodiment discussed above and shown in the figures, but may be implemented in various ways without departing from the spirit of the invention.

For example, in the above embodiment, the feed screw mechanism 21 is constructed by engaging the rotation spindle 38 and screwed shaft 39 directly. The feed screw mechanism 21, however, may be constructed by connecting the rotation spindle 38 and the screwed shaft 39 indirectly through a gear or a ball.

In the above embodiment, the screw nut 41, the lid 42, and the circlip 43 are formed as separate members. At least two of the members 41–43, however, may be formed as a single member.

In addition, the screwed shaft 39 may be connected with the control shaft 12 not coaxially but eccentrically.

The radial bearing 23 may be an angular contact type roller bearing including an inner race 56, an outer race 57 or an angular contact type ball bearing including an inner race 56, an outer race 57. The radial bearing 23 may be replaced with radial bearing which does not contain lubricating fluid such as grease. In addition, the thrust bearing 22 may be an angular contact type or axial contact type roller bearing. Moreover, the thrust bearing 22 may be disused.

In the above embodiment, the rotation restriction bush 51 and the screwed shaft 39 are radially engaged by means of the involute splines 50 and 52. The involute splines 50 and 52 may be, however, eliminated if each of the rotation restriction bush 51 and the screwed shaft 39 has a structure by which the rotation restriction bush 51 and the screwed shaft 39 are radially engaged and slide in the axial direction each other.

In the above embodiment, the motor unit 26 is constructed by an IPM brushless motor which has the rotating rotor 65 and the permanent magnet 68 embedded in the rotating rotor 65. The motor unit 26, however, may be constructed by any other known motor such as a DC motor.

In addition, the controlling circuit 90 may be incorporated in the circuit case 80 as a member of the electric power distributor 29. In addition, the Hall elements 76 are used as sensor elements constituting the sensing unit 28. The sensor elements, however, may be magnetoresistive elements. The number of the sensors can be arbitrarily determined.

In addition, the changing mechanism 8 described in FIG. 2 may be replaced with any other device if the device changes the valve lift amount according to the position of control shaft 12 in the axial direction.

In addition, the actuator 10 may be used in combination with a changing mechanism applying, by means of the valve resistance force applied to the control shaft 12, a force to the screwed shaft 39 in the axial direction toward the electric power distributor 29.

In addition, the actuator 10 may be used in combination with a changing mechanism controlling a lift amount of an exhaust valve of an engine.

What is claimed is:

1. An actuator for a valve lift controller controlling a lift amount of an intake valve and/or an exhaust valve, the actuator linearly driving a control shaft of a changing mechanism changing the lift amount according to a position of the control shaft in an axial direction thereof, comprising:

a case forming a first space and a second space therein, the first space being supplied with lubricating fluid;

a feed screw mechanism including:

a rotation spindle which has a shape of a cylinder and includes a first end portion and a second end portion, the first end portion connecting the first space with an interior space of the rotation spindle, the second end portion separating in the second space the second space from the interior space;

a screwed shaft which is located straddling borders between the interior space, the first spaces, and an external space of the case, the feed screw mechanism converting a rotational movement of the rotation spindle to a linear movement of the screwed shaft;

a motor unit including a coil located in the second space, the motor unit rotating the rotation spindle when the coil is excited; and a sealing member sealing a gap between the case and the rotation spindle to separate the first space and the second space.

2. The actuator according to claim 1, further comprising a first bearing located in the second space, the first bearing supporting the rotation spindle against a radial force applied to the rotation spindle.

3. The actuator according to claim 1, further comprising a second bearing located in the first space, the second bearing supporting the rotation spindle against a thrust force applied to the rotation spindle.

4. The actuator according to claim 1, further including an electric power distributor for supplying electric power to the motor unit, the electric power distributor including:

a circuit case forming a communication hole, an conductive member in the communication hole, and a container space communicating with the second space through the communication hole; and an electric circuit located in the container space, the electric circuit being electrically connected with the coil through the conductive member in the communication hole.

5. The actuator according to claim 1, further comprising a sensing unit exposed to the second space, the sensing unit detecting a rotational angle of the rotation spindle.

6. The actuator according to claim 1, wherein, the case includes a rotation restriction unit restricting rotation of the screwed shaft by being radially engaged with the rotation spindle, and the lubricating oil supplied to the first space is discharged to the external space through a gap between the rotation spindle and the rotation restriction unit.

7. The actuator according to claim 6, wherein the rotation spindle includes a first spline, the rotation restriction unit includes a second spline, and the first spline and the second spline are engaged with each other.

* * * * *

UNITED STATES PATENT AND TRADEMARK OFFICE
Certificate

Patent No. 7,246,579 B2 Patented: July 24, 2007

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Kiyoshi Kimura, Obu (JP); Shigeru Yoshiyama, Kariya (JP); Taku Itoh, Chita-gun (JP); Hideo Inaba, Okazaki (JP); Joji Yamaguchi, Chiryu (JP); Akihiko Kameshima, Hekinan (JP); Toshiki Fujiyoshi, Okazaki (JP); and Koichi Shimizu, Toyota (JP).

Signed and Sealed this Twenty-third Day of February 2010.

THOMAS E. DENION
*Supervisory Patent Examiner*
Art Unit 3748